United States Patent [19]

Leotta

[11] 4,099,809

[45] Jul. 11, 1978

[54] COLLAPSIBLE WORK STATION

[76] Inventor: Samuel S. Leotta, 303 Harry St., Conshohocken, Pa. 19428

[21] Appl. No.: 714,259

[22] Filed: Aug. 13, 1976

[51] Int. Cl.[2] ..... A47B 43/00

[52] U.S. Cl. ..... 312/140.2; 312/258; 312/265

[58] Field of Search ..... 52/27, 70, 239; 297/184; 312/140.1-140.4, 258, 265; 108/60, 34, 153, 159

[56] References Cited

U.S. PATENT DOCUMENTS

| | | | |
|---|---|---|---|
| 963,853 | 7/1910 | Benson | 312/258 |
| 1,141,808 | 6/1915 | McGinley | 52/70 |
| 1,188,973 | 6/1916 | Montgomery | 312/258 |
| 2,764,462 | 9/1956 | McDonald | 312/140.2 |
| 3,140,133 | 7/1964 | Kraft | 312/140.2 |
| 3,955,864 | 5/1976 | MacDonald et al. | 312/258 |

*Primary Examiner*—Casmir A. Nunberg
*Attorney, Agent, or Firm*—Duffield and Lehrer

[57] ABSTRACT

A device for providing work surfaces for writing, typing or other such activities, that collapses to an easily storable position and readily reassembles for use. The device includes a plurality of hinged work surfaces of shelves, which are connected to a rear support wall and in the assembled position are also connected to side support walls. The side support walls are, in turn, also connected to the rear support wall. In addition, partition extension walls can be connected and disconnected from the side support walls to provide increased seclusion from adjoining areas when the device is used in a crowded area.

2 Claims, 7 Drawing Figures

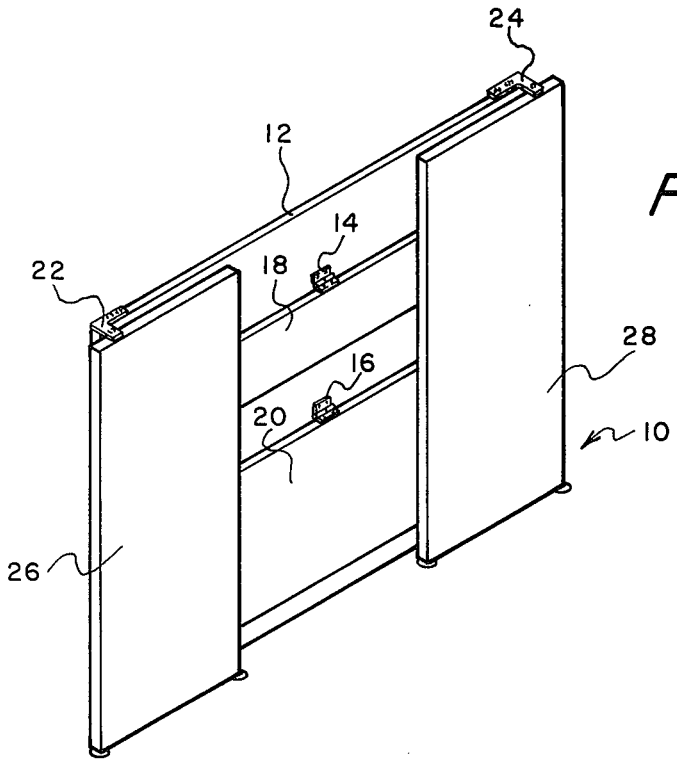
Fig. 1
Fig. 2
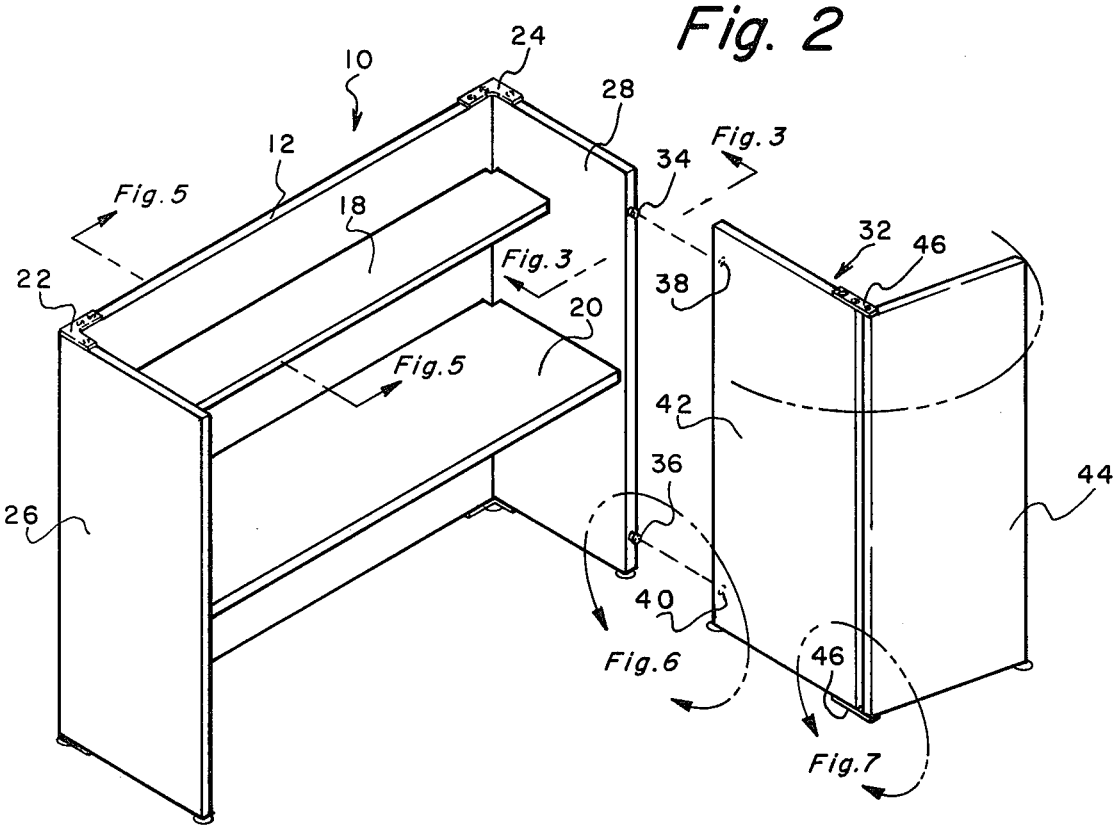

COLLAPSIBLE WORK STATION

BACKGROUND OF THE INVENTION

The present invention generally relates to the broad field of collapsible work stations or related apparatus, and more particularly to those devices which collapse for storage and reassemble for use.

Devices of this general type are shown, for example, in Pat. No. 1,045,854 issued to E. N. Kevitt and J. Gemeinhardt. The patent is more particularly directed toward a folding election booth and is of limited application. The patented device is intended only for short temporary use during elections that occur once or twice every calendar year. On the other hand, the device embodied in the present application is of a more substantial construction and support, featuring more available work surface and firmer support to that work surface, as well as easier break-down and set-up procedure.

BRIEF DESCRIPTION OF THE INVENTION

A folding or collapsible work station comprises a rear support wall having a plurality of shelves of varying sizes hinged thereto. The hinge means allows the shelves to assume various positions with respect to the rear support wall, of which positions two are of practical importance: the first being the storing position in which each individual shelf has its broadest surface parallel and in contact with the upright surface of the rear support wall, and the second in which the broadest surface of the shelves are perpendicular to said upright surface of the rear support wall. Attached to the rear support wall by a second hinging means are two side support walls which fold from an upright position to a folded or storing position. In the folded position the side support walls are parallel to the upright surface of the rear support wall and in contact with the broadest surface of the shelves, which are also in the storing position; thereby providing a flat unit having a thickness which is the sum of the individual sections, i.e. the rear support wall, the side support walls and shelves. In the upright position the side support walls are perpendicular to the rear support wall and the plurality of shelves. Interconnecting the shelves to the side support walls are detachable support brackets that retain the shelves in the upright position and perpendicular to both the rear support wall and side support walls.

There is also disclosed an additional panel, known as partition extension walls, that connect to the upright side support walls by a screw and key slot means to provide additional privacy screening. The partition extension walls consist of two sub-walls connected to one another by a third hinging means to allow varied placement of the two sub-walls to each other thereby providing varied configurations of the work station in conjunction with surrounding areas or other work stations.

It is an object of this invention to provide a work station to be used in a temporary or semi-permanent position, that is easily set-up and broken down, yet which remains stable while in use. Another object is to provide a minimum storage area requirement and easy transportation of the stored work station from place to place. A simple construction is an additional feature provided through the use of wood or similar material to construct the major members of the device and ordinary house-hold hinges providing the main connections between said members. The last connection means, between the shelves and side support walls is also of simple construction.

For the purpose of illustrating this invention there is shown in the drawings a form which is presently preferred; it being understood, however, that the invention is not intended to be limited to the precise features and instrumentalities shown.

BRIEF DESCRIPTION OF THE DRAWINGS

FIG. 1 is a perspective view of the device of the present invention in the folded or collapsed position;

FIG. 2 is a perspective view of the device in the upright position for use, and additional partition extension walls;

DETAILED DESCRIPTION OF THE PREFERRED EMBODIMENT

Figure 3:
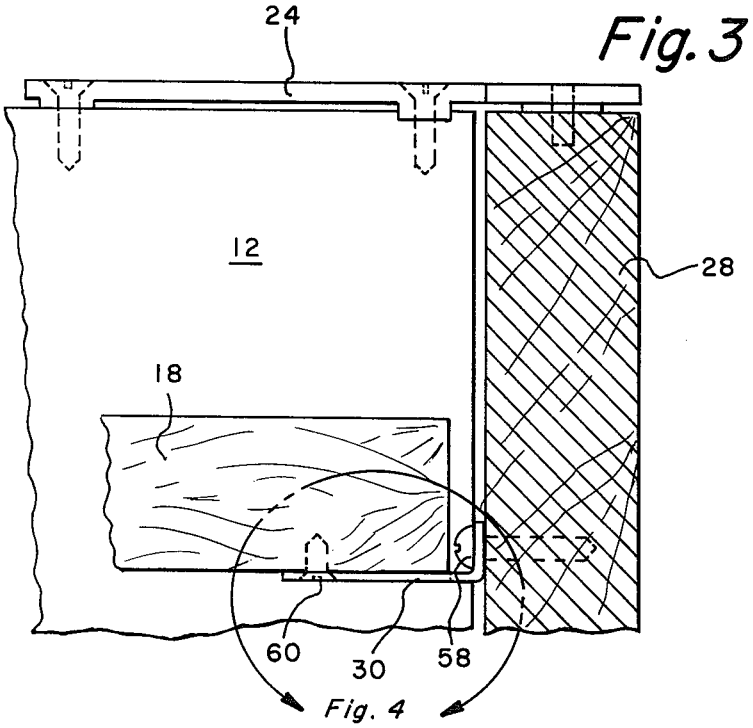
FIG. 3 is a sectional view taken along the line 3—3 in FIG. 2.

Referring now to the drawings in detail, wherein similar reference numerals designate similar elements throughout the several figures, there is shown in FIG. 1 a perspective view of a collapsible work station constructed in accordance with the principles of the present invention and designated generally as 10. Collapsible work station 10 comprises a rigid rear support wall 12, to the front surface of which there is connected by a first set of hinges 14 and 16 shelves 18 and 20. Shelves 18 and 20 are of different widths, but each has a length equal to the width of the rear support wall 12. Attached to each side of the rear support wall 12 by a second pair of hinges 22 and 24 are side support walls 26 and 28. Interconnecting the side support walls 26 and 28 to the shelves 18 and 20 are detachable support brackets 30 (see FIGS. 3 and 4), which act to support the shelves perpendicular to the rear support walls 12 and the side support walls 26 and 28, when the detachable support brackets 30 are in use as shown in FIG. 2. When the detachable support brackets 30 are not in use, the shelves 18 and 20, and side support walls 26 and 28 collapse or fold onto the rear support wall 12 as shown in FIG. 1.

As shown in FIG. 2, partition extension wall 32 is connected to the side support wall 28 by a connecting means which includes screws 34 and 36 in the end of wall 28 and key slots 38 and 40 located in the end of wall 32. Partition extension wall 32 is preferably comprised of two sub-walls 42 and 44 connected together by connectors 46. Connectors 46 allow the sub-wall 42 to be pivotally moved in relation to sub-wall 44 for different configurations of the total work station when erected, and to further collapse partition extension wall 32 for storage. Storage of the partition extension wall 32 is performed by removing pin 48 from the connectors 46 to allow sub-walls 42 and 44 to fold together with the flat surfaces of each sub-wall in contact with the other. When erected, pin 48 is again inserted to allow sub-walls 42 and 44 to pivot with respect to one another.

Figure 6:
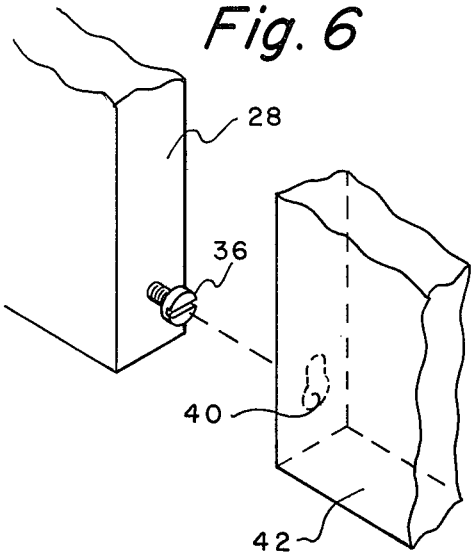
FIG. 6 is a detailed view of the circled area shown in FIG. 2.
Figure 7:
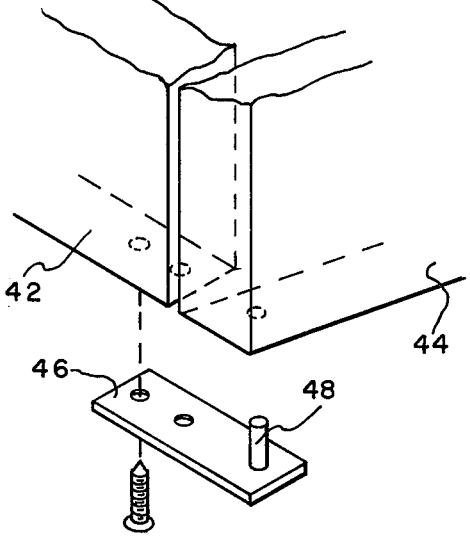
FIG. 7 is a detailed view of the other circled area shown in FIG. 2.

The connecting means between the side support wall 28 and the sub-wall 42 operate by gravity. Specifically, the small end of the key slot 40, for example, is held over the head of screw 36 located in the end of side support wall 28, as detailed in FIG. 6. For storage, partition extension wall 32 is lifted up and away from side support wall 28 to bring the head of screw 36 to the large portion of key slot 40 where the screw head is released from the constriction of the key slot. Assembly of the structure at this point is, of course, in the opposite direction.

Figure 4:
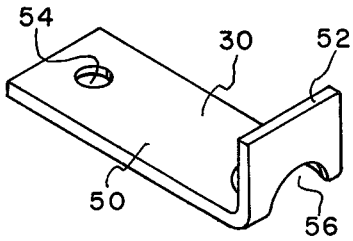
FIG. 4 is a perspective view of a detachable support bracket used in conjunction with the present invention.
Figure 5:
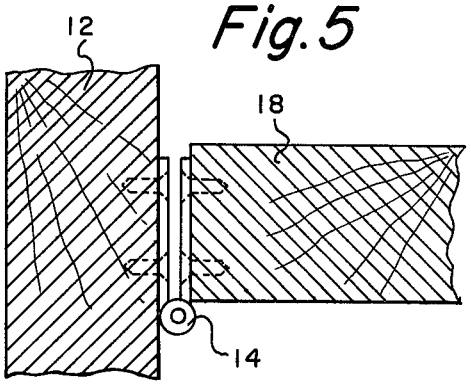
FIG. 5 is a sectional view taken along the line 5—5 in FIG. 2.

Detachable support brackets 30 function in the following manner. As shown best at FIG. 4, each bracket 30 is L-shaped having a first portion 50 and a second portion 52. First portion 50 includes a small screw hole 54 and a larger hole 56 is located at the bend between first and second portions 50 and 52. Hole 56 is adapted to fit over the head of screw 58 which projects from the side support wall 28 as shown in FIG. 3. It should be readily apparent that a plurality of screws such as 58 are located on each of the side support walls 26 and 28 and are positioned such that when the brackets 30 are in place, the shelves are perpendicular to the back and side walls and parallel to the floor. For temporary installations, the brackets 30 may be simply slid over the projecting heads of the screws 58 and the shelves can simply rest on the first portion 50 of the brackets. For more permanent installations, the screws 50 may be tightened after the brackets 30 are slid over the same and a screw 60 can be used to securely fasten the shelve to the bracket.

From a collapsed position of the main work station 10, i.e. all of the above described components except the partition extension wall 32, the work station 10 is assembled in the following fashion. Side support walls 26 and 28 are unfolded to a perpendicular position with respect to the rear support wall 12 and shelves 18 and 20 are raised to a perpendicular position with respect to both the rear support wall 12 and side support walls 26 and 28. Detachable support brackets 30 are then inserted between shelves 18 and 20 and side support walls 26 and 28 to maintain the perpendicular relation of the side support walls and the shelves. The partition extension wall 32 may then be added if desired, as described above. To store the work station the reverse procedure is adopted: lowering the shelves, then folding the side support walls flat against the shelves and rear support wall. It should be pointed out that the hinges 22 and 24 pivotally mount the side support walls 26 and 28 such as when they are in the collapsed position as shown in FIG. 1, i.e. parallel to the rear support wall 12, they are spaced from the rear support wall by a distance which is substantially equal to the thickness of the shelves 18 and 20. This makes the device assembly transportable.

It should be readily apparent that the number of shelves and their positions shown in the various figures is by way of example only and that fewer or greater numbers of shelves may be employed. In addition, the depth of the shelves may vary depending on the intended use of the work station.

As illustrated, for example, the work station may be used as a desk, with shelf 20 serving as a writing surface or a support for a typewriter. Furthermore, while the drawings have been shaded to show the various elements being comprised of wood, it should be readily apparent that any similar material may be employed.

The present invention may be embodied in other specific forms without departing from the spirit or essential attributes thereof, and, accordingly, reference should be made to the appended claims, rather than to the foregoing specification as indicating the scope of the invention.

I claim:

1. A collapsible work station comprising a rear support wall having a front and back surface and a pair of side support walls, means pivotally mounting each of said side support walls to a different side edge of said rear support wall such that said side support walls may be pivoted toward each other and toward said front surface of said rear support wall; a plurality of shelves, the length of each of said shelves being substantially equal to the width of said rear support wall, each of said shelves being pivotally mounted to said front surface of said rear support wall and being movable between a first position wherein said shelves are parallel to said rear wall and a second position wherein said shelves are perpendicular to said rear wall, support means associated with said side support walls for maintaining said shelves in said second position; said means pivotally mounting said side support walls mounting said side walls such that when they are pivoted toward the front surface of said rear support wall and substantially parallel thereto, they are spaced from said front surface of said rear wall a distance at least equal to the thickness of said shelves, whereby said station is collapsed by first pivoting said shelves to their first position wherein they are parallel to the front surface of the rear support wall and thereafter pivoting said side support walls toward said front surface of said rear support wall so that they lie on said shelves.

2. A collapsible work station comprising a rear support wall having a front and back surface and a pair of side support walls, means pivotally mounting each of said side support walls to a different side edge of said rear support wall such that said side support walls may be pivoted toward each other and toward said front surface of said rear support wall; a plurality of shelves, the length of each of said shelves being substantially equal to the width of said rear support wall, each of said shelves being pivotally mounted to said front surface of said rear support wall and being movable between a first position wherein said shelves are parallel to said rear wall and a second position wherein said shelves are perpendicular to said rear wall, support means associated with said side support walls for maintaining said shelves in said second position; a partition wall and means for temporarily connecting said partition wall to the free end of one of said side walls; said means pivotally mounting said side support walls mounting said side walls such that when they are pivoted toward the front surface of said rear support wall and substantially parallel thereto, they are spaced from said front surface of said rear wall a distance at least equal to the thickness of said shelves, whereby said station is collapsed by first pivoting said shelves to their first position wherein they are parallel to the front surface of the rear support wall and thereafter pivoting said side support walls toward said front surface of said rear support wall so that they lie on said shelves.

* * * * *